United States Patent [19]

Holden

[11] 4,349,146

[45] Sep. 14, 1982

[54] PACKAGING TRAY

[75] Inventor: M. James Holden, Canandaigua, N.Y.

[73] Assignee: Mobil Oil Corporation, New York, N.Y.

[21] Appl. No.: 211,005

[22] Filed: Nov. 28, 1980

[51] Int. Cl.[3] ..... B65D 1/34; B65D 65/16

[52] U.S. Cl. ..... 229/2.5 R; 206/45.33; 229/DIG. 12

[58] Field of Search ..... 229/2.5 R, DIG. 12, 229/29 M; 206/45.33; 426/129, 396, 124; 217/26, 26.5; D9/424, 425, 427

[56] References Cited

U.S. PATENT DOCUMENTS

| | | | |
|---|---|---|---|
| D. 199,701 | 12/1964 | Kennedy | D9/425 |
| 1,637,100 | 7/1927 | Bothe | 229/2.5 R |
| 3,346,400 | 10/1967 | Roesner | 426/129 |
| 3,603,499 | 9/1971 | Snow | 229/29 M |
| 3,718,274 | 2/1973 | Reifers et al. | 229/2.5 R |
| 3,720,365 | 3/1973 | Unger | 229/2.5 R |
| 3,761,011 | 9/1973 | Reifers et al. | 206/45.33 |
| 4,162,759 | 7/1979 | Reifers et al. | 229/2.5 R |

*Primary Examiner*—William Price
*Assistant Examiner*—Gary E. Elkins
*Attorney, Agent, or Firm*—Charles A. Huggett; Michael G. Gilman; James F. Powers, Jr.

[57] ABSTRACT

A molded food packaging tray for use in packaging meats, fish, poultry and other comestibles in conjunction with a transparent overwrap film. The inventive packaging tray is provided with a novel peripheral lip structure which will aid in preventing the collapse or fracture of the tray side walls in view of pressures exerted by the overwrap film when applied to the tray in an automatic tray overwrap machine.

7 Claims, 6 Drawing Figures

PACKAGING TRAY

BACKGROUND OF THE INVENTION

The present invention relates to a packaging tray and, more particularly to a molded food packaging tray for use in packaging meats, fish, poultry and other comestibles in conjunction with a transparent overwrap film. The inventive packaging tray is provided with a novel peripheral lip structure which will aid in preventing the collapse or fracture of the tray side walls in view of pressures exerted by the overwrap film when applied to the tray in an automatic tray overwrap machine.

In many modern food retailing operations, such as in supermarkets, meat and produce markets and the like, there are customarily employed food trays molded from wood or paper pulp or from various plastic material, for instance, foamed plastic, for the display and packaging of meats, fish, poultry and other produce or comestibles. Generally these trays are relatively shallow rectangular flat-bottomed trays having outwardly inclined side walls, into which the commodities are placed, and thereafter a transparent material such as heat sealable cellophane or heat shrinkable or stretchable plastic film is tightly wrapped and sealed about the tray bottom to form an attractive retail package. This type of package is extremely neat in appearance, forms a protective arrangement for the commodity contained therein while allowing the prospective customers to view its contents, so as to greatly assist in the sale of the commodities.

Heretofore, the sealing of the commodity-containing tray with the transparent overwrap film was usually effected manually by generally unskilled or semiskilled labor. Although the packages obtained in this manner were, as a rule, satisfactory in their appearance and quality of sealing the commodities, the procedure was slow and cumbersome and not at all adapted to high-volume production demands.

More recently, there have been developed automatic tray overwrap machines which, at extremely high rates of speed, will cover and seal a tray containing a commodity, such as meat, fish, poultry or the like, with a transparent overwrap film of a suitable material as mentioned hereinabove. Although the automatic machines fulfill the demand for supplying wrapped trays of the type in question to a highly satisfactory degree, serious problems have been encountered in their use. Thus, the automatic overwrap machines when positioning or contacting the trays for contact with the overwrap film, and during the sealing of the film to the trays, are proned to impart relatively high forces to the sidewalls of the trays, thereby generating extremely high localized stresses which frequently cause to the tray side or end walls to buckle and fracture. This buckling may be the result of the inwardly directed forces exerted on the side walls of the tray due to impact by the machines and/or the tension formed by the overwrap film which is being applied to the trays.

Further basic causes of tray failure when the trays are overwrapped with transparent film in automatic machines may be ascribed to poor tray design for intended application thereof, in essence, inadequate side wall and tray bottom strength; incorrect design criteria in relationship between tray bottom and upright wall structures; design of automatic equipment, and the like.

To summarize, the typical failures of meat trays in automatic tray overwrap equipment relate to:

1. Bending or breaking at the sidewall to bottom radius due to the concentration of inward or outward bending moment forces at this point in that tray.

2. Distortion, folding or breaking of the trim lip due to the large contact area of the trim flange on the tray and the high coefficient of friction of the foam tray surface and the overwrap film surface.

3. Bowing of the trays when subjected to the wrapping forces in the equipment, and the related package instability through the remainder of the automated weighing/pricing/labeling equipment.

DISCUSSION OF THE PRIOR ART

To some degree, the prior art has taken cognizance of the problems encountered in the wrapping of trays with an overwrap film of the type described.

Thus. R. F. Reifers et al. U.S. Pat. No. 3,761,011 describes a food packaging tray in which the side walls and end walls incorporate outwardly and downwardly extending peripheral lips adapted to resist collapse of the loaded tray caused by pressure exerted by the transparent overwrap plastic film. However, the lip construction in this patent is of a rather complex configuration and would unduly increase the cost of the tray. Moreover, the Reifers tray does not appear to be constructed to withstand the high impact loads applied thereto when used in automatic tray overwrap machines.

Other patents which illustrate lip structures on the tray side and end walls include the R. P. Rynning U.S. Pat. No. 3,986,655 and U.S. Pat. Des. Nos. 227,004; 245,070 and 256,220. However, none of the lip structures disclosed in these publications are of the type adapted to aid the strength of the tray against failures caused by automatic overwrap machines.

SUMMARY OF THE INVENTION

Accordingly, it is an object of the present invention to provide a packaging tray of the type described hereinabove which includes lip structure on the side walls of the tray adapted to resist stresses tending to cause failure of the tray.

A more specific object of the invention resides in the provision of a tray incorporating structure which will protect the tray from fracturing or collapsing when wrapped with a transparent overwrap film in an automatic overwrap machines.

In order to meet the foregoing and other objects, the novel lip structure employed on the tray side wall periphery is of a special configuration which minimizes contact with the overwrap film and concurrently avoids the formation of high localized stresses conducive to tray failure.

BRIEF DESCRIPTION OF THE DRAWINGS

Reference may now be had to the following detailed description of preferred embodiments of the invention, taken in conjunction with the accompanying drawings; in which.

DETAILED DESCRIPTION OF THE DRAWINGS

Figure 1:
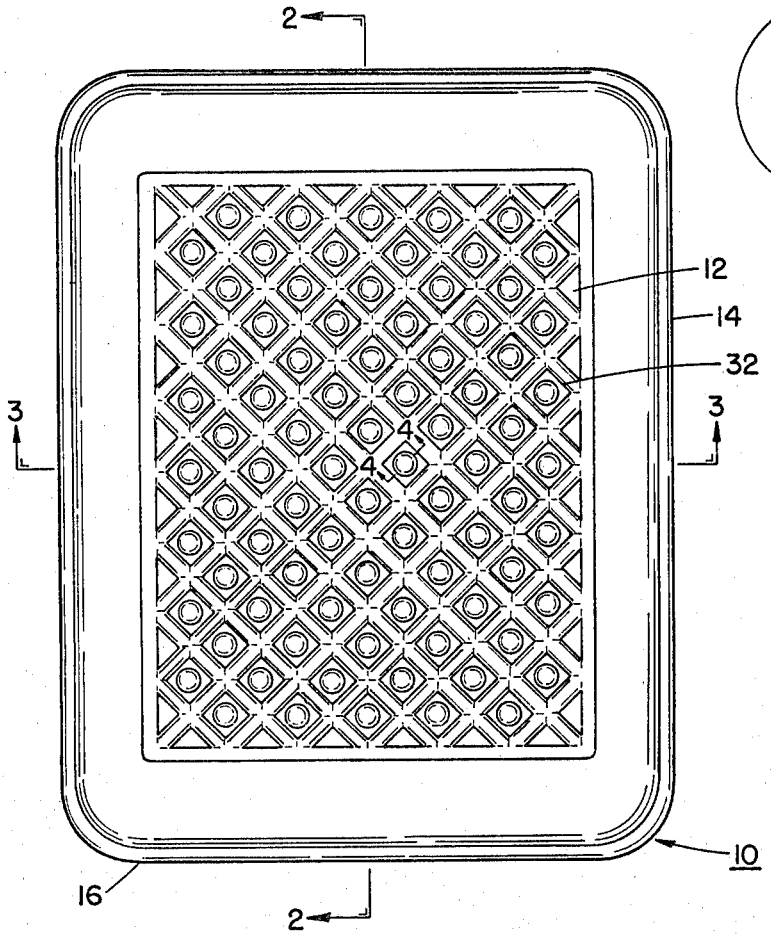
FIG. 1 illustrates a top plan view of a packaging tray constructed pursuant to the invention.
Figure 2:
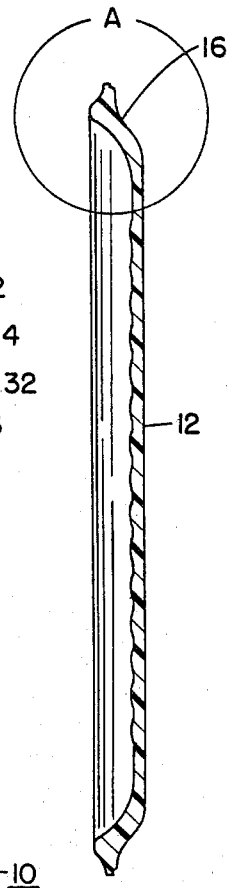
FIG. 2 is a sectional view taken along line 2—2 in FIG. 1.
Figure 3:
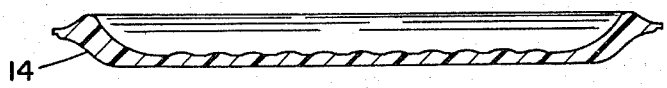
FIG. 3 is sectional view taken along line 3—3 in FIG. 1.
Figure 4:
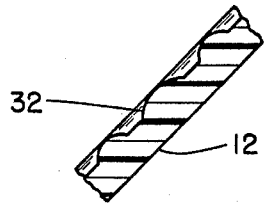
FIG. 4 is a fragmentary sectional view taken along line 4—4 in FIG. 1.

As shown in the drawings, and particularly FIGS. 1 through 5, the inventive packaging tray 10 includes a flat bottom portion 12 and upwardly and outwardly inclined side walls 14 and 16. The tray is formed of suitable molded and foamed plastic material, as is well known in the art.

Figure 5:
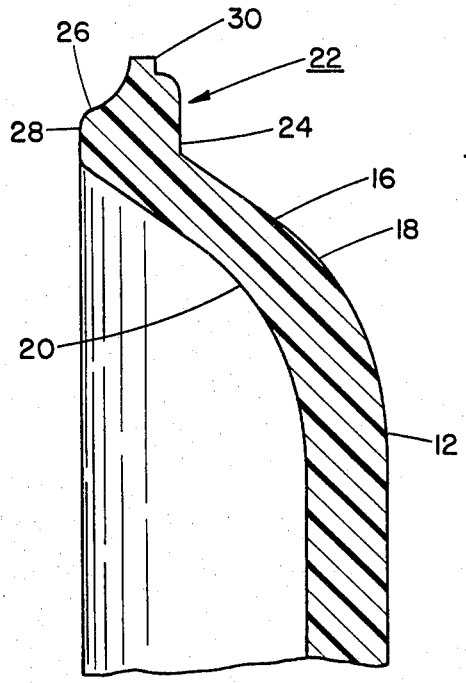
FIG. 5 is an enlarged scale sectional view of the encircled portion A in FIG. 2.

Having particular reference to the enlarged FIG. 5 of the drawings, the sidewalls 14, as well as end walls 16, which are also referred to as side walls for purposes of simplicity, curve into the tray bottom structure 12 with large radii, wherein the outer transition radius 18 is equal to or larger than the inner transition radius 20 so as to avoid any localized stress concentrations between the bottom of the tray and the side walls. There is also an increased thickness of the side walls 14, 16 towards the transition with the bottom tray structure 12.

At the upper end of the side walls 14, 16 there is provided a radially outwardly extending peripheral lip structure 22 having a generally flat bottom surface 24 and a concavely curved radius 26 at the upper surface 28. Extending outwardly of the lip structure is a small trim lip 30 of generally rectangular cross-section which will reduce the area of contact with the overwrap film when the latter is applied by hand or on an automatic overwrap machine. The reverse trim lip will also slightly reduce the vertical side wall bending moment. Thus when overwrap film is applied to the upper end of the tray, the contact area, and resultant stresses, are maintained at an acceptable minimum. Preferably, the concave curvature between the apex of the tray and the trim points on the trim lip represents 10 to 50% of the total tray height. The interior of the tray bottom structure 12 may be provided with a suitable decorative embossing 32 which will allow for more effective tray cooling during the manufacturing process thereof.

Figure 6:
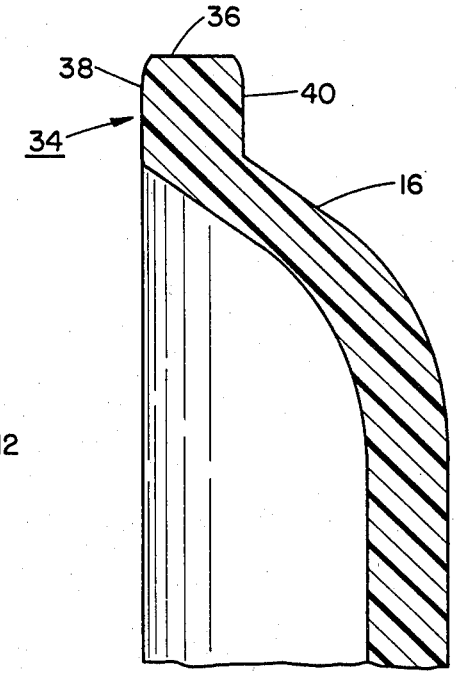
FIG. 6 is an enlarged scale sectional view of a modified embodiment of lip structure on the side wall of a tray.

In a modified embodiment of the lip structure 34 shown in FIG. 6 of the drawings, the lip is of a generally rectangular cross-section having a flat inwardly sloping end surface 36 and flat upper and lower surfaces 38, 40.

While the tray of the present invention may be molded of conventional wood or paper pulp stock which nay be formed or preformed from a water slurry, it will be understood that the contruction provided is particularly suitable to the manufacture, preferably by molding, of trays from other materials, particularly foam plastic or even solid plastic. Thus, the tray of the present invention may be formed of other, equivalent materials, the structural advantages of the tray deriving from its geometry. Among other materials there may be mentioned conventional polystyrene foam, structural cellular polystyrene foam, porous polyolefin material, open cell polystyrene foam, or biodegradable foam polystyrene.

What is claimed is:

1. In a molded tray for the packaging of meat, fish, poultry, comestibles or the like in conjunction with a transparent overwrap film extending thereabout, said tray comprising upwardly and outwardly inclined side walls forming the sides of said tray; bottom wall means including a substantially flat bottom wall for supporting said meat, fish, poultry, comestibles or the like; and a large-radius curved wall portion extending between said bottom wall and the lower ends of said side walls so as to provide a smoothly contoured transitional surface, the improvement wherein:

said inclined side walls have a radially outwardly extending lip portion extending about said side walls proximate the upper ends thereof, said lip portion having a concavely downwardly and outwardly curving upper surface extending from a rounded edge on said side walls, a generally rectangular protuberance in cross-section smaller than said lip portion projecting radially outwardly of and about said lip portion so as to constitute a narrow trim lip, said trim lip having the upper surface extending from the lower outer end of said concavely curved surface and having sharp-cornered upper and lower edges, and said lip portion having a generally horizontal planar bottom surface extending outwardly of said sidewalls below the bottom plane of said trim lip and having a convexly rounded outer edge joining the bottom plane of said trim lip radially inwardly of the outer face of said trim lip whereby transparent overwrap film extending about said tray lip portion will primarily contact and engage the rounded edge on said side walls, the sharp-cornered upper and lower edges on said trim lip and the rounded outer edge on the bottom surface of said lip portion so as to maintain a minimum surface contact between said overwrap film and said tray.

2. A tray as claimed in claim 1, said large-radius curved wall portion between said bottom wall and said side walls having an external radius at least as large as the internal radius.

3. A tray as claimed in claim 1, said large-radius wall portion being of an increasing thickness extending from said side walls towards the tray bottom wall.

4. A tray as claimed in claim 1, said lip portion having a vertical height in a range of about 10 to 50% of the overall height of said tray.

5. A tray as claimed in claim 1, said side walls having a thickness less than the thickness of said bottom wall.

6. A tray as claimed in claim 1, comprising a decorative pattern being formed in at least the interior surface of said bottom wall.

7. A tray as claimed in claim 6, said decorative pattern extending into the thickness of said tray bottom wall.

* * * * *